United States Patent [19]

Rieger

[11] 4,257,204

[45] Mar. 24, 1981

[54] PREFABRICATED INSULATED PANEL AND WALL STRUCTURE PRODUCED THEREFROM

[75] Inventor: Martin C. Rieger, Willoughby, Ohio

[73] Assignee: Childers Products Company, Inc., Cleveland, Ohio

[21] Appl. No.: 900,294

[22] Filed: Apr. 26, 1978

[51] Int. Cl.[3] ..... E04D 1/28; E04C 2/26; E04B 1/80

[52] U.S. Cl. ..... 52/395; 52/404; 52/527; 52/542; 52/539; 52/593

[58] Field of Search ..... 52/527, 404, 542, 549, 52/593, 531, 588, 539, 395

[56] References Cited

U.S. PATENT DOCUMENTS

| | | | |
|---|---|---|---|
| 3,109,206 | 11/1963 | Beam | 52/404 |
| 3,217,453 | 11/1965 | Medow | 52/593 |
| 3,304,680 | 2/1967 | Birdwell | 52/404 |
| 3,740,916 | 6/1973 | Kenaga | 52/593 |
| 3,961,454 | 6/1976 | Adams | 52/542 |
| 4,100,711 | 7/1978 | Skuran | 52/539 |
| 4,130,975 | 12/1978 | Kelley | 52/588 |

*Primary Examiner*—John E. Murtagh
*Attorney, Agent, or Firm*—David A. Burge

[57] ABSTRACT

A prefabricated insulated panel includes a sheet-like face member and an insulating mat extending along one surface of the face member. Complementary male and female formations extend along opposed edges of the face member and are adapted to matingly couple adjacent panels to form a contiguously extending insulated wall structure. The face member has an upstanding flange which is offset from one of the edges of the face member and which cooperates with such edge to define a recess adapted to receive the insulating mat of the next adjacent panel therein. The flange is adapted to facilitate attachment of the panel to a support and in a manner aiding in preventing heat flow through the panel. Each panel has a side edge structure which is constructed and arranged to minimize heat transmission through abutting side joints of adjacent panels while, at the same time, allowing for expansion and contraction of the panels.

21 Claims, 16 Drawing Figures

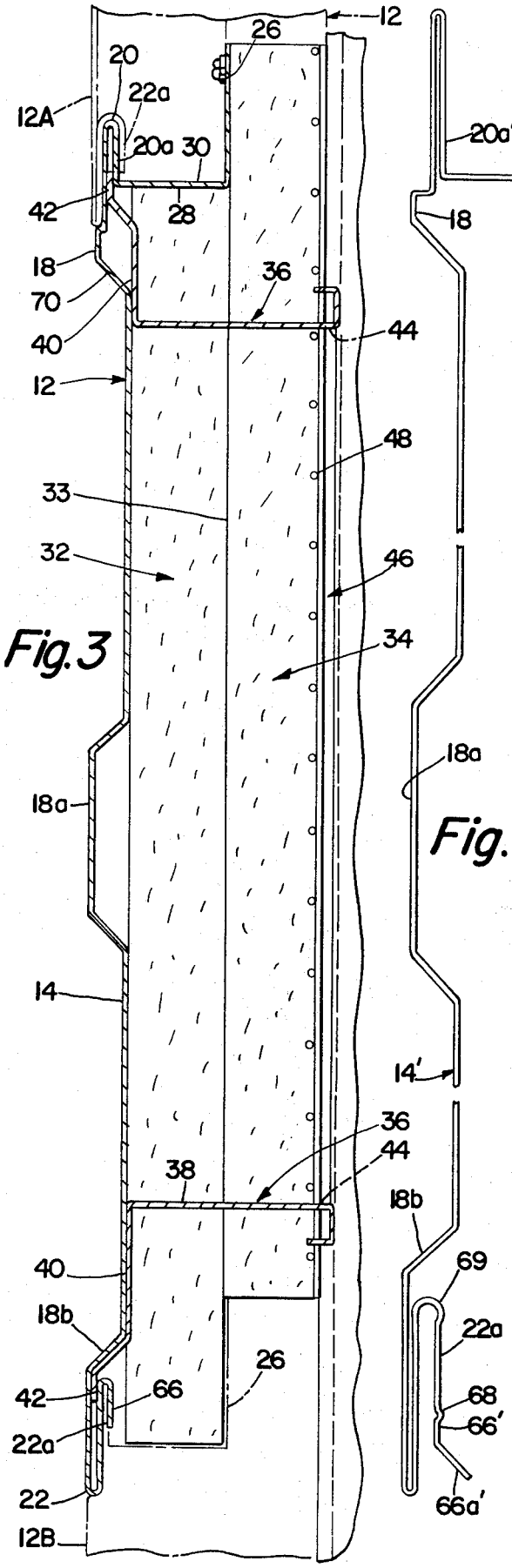
Fig. 3
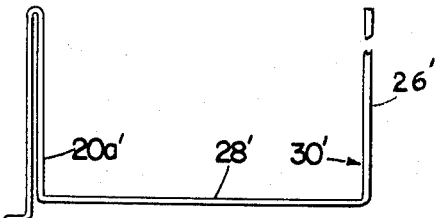
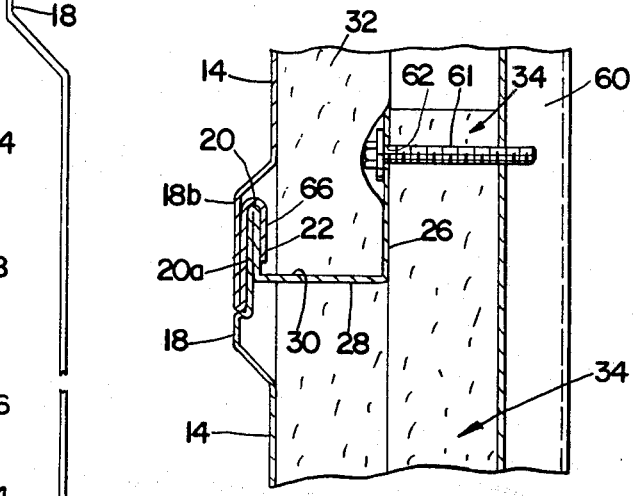
Fig. 4
Fig. 5
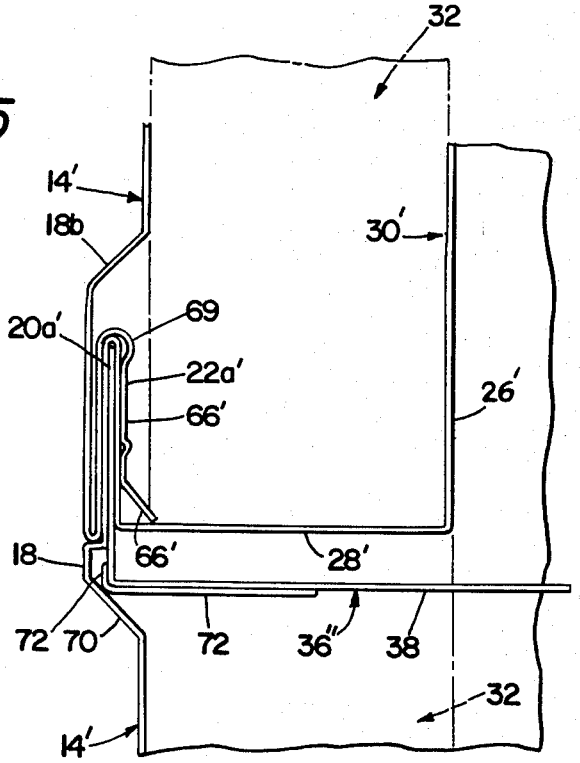
Fig. 6

PREFABRICATED INSULATED PANEL AND WALL STRUCTURE PRODUCED THEREFROM

BACKGROUND OF THE INVENTION

1. Field of the Invention

This invention relates to a prefabricated insulated panel which may be assembled with other like panels to form a contiguously extending insulated wall structure and, more particularly, to a panel which is usable in installations where temperatures may range from approximately 0 degrees F. to 1000 degrees F.

2. Prior Art

Many prefabricated insulated wall panel configurations have been proposed. Two such proposals are presented in U.S. Pat. Nos. 3,961,454 and 3,879,910 dated June 8, 1976 and Apr. 29, 1975, respectively. A problem with these proposals is that, when such panels are assembled to form a wall structure, the capability of the resulting wall structure to prevent or limit heat flow through the wall structure, especially at the junctures of adjacent panels, leaves much to be desired.

SUMMARY OF THE INVENTION

The present invention overcomes the foregoing and other drawbacks of prior proposals by providing a prefabricated insulated panel which may be assembled with like panels to form a particularly effective insulated wall structure. A feature of panels embodying the preferred practice of the present invention is that they may be rapidly and expeditiously assembled to form a contiguously extending wall structure which will effectively insulate an area.

Accordingly, a feature of the invention lies in the provision of a novel, prefabricated insulated panel, adapted for assembly with like panels, to form an insulated wall structure.

A further feature of the invention lies in the provision of an insulated panel which includes opposed edges having complementary male and female formations for coupling adjacent panels together to form a contiguously extending wall structure. An edge flange is provided along one of the edges of each of the panels for connecting the panels to an associated support.

A further feature of the invention lies in the provision of a prefabricated insulated panel of the type described which can be effectively coupled with other like panels to form an insulated wall structure wherein edge junctures of adjacent panels form effective barriers to heat loss.

A still further feature of the invention lies in the provision of a prefabricated insulated panel of the aforementioned type having a plurality of insulating mats arranged in a manner which minimizes heat loss through the panel.

Other features and advantages of the invention will be apparent from the following description taken in conjunction with the accompanying drawings.

BRIEF DESCRIPTION OF THE DRAWINGS

FIG. 3 is a sectional view on an enlarged scale as seen from a plane indicated by a line 3—3 in FIG. 2.

FIG. 4 is a sectional view on an enlarged scale as seen from a plane indicated by a line 4—4 in FIG. 10.

FIG. 5 is a foreshortened end elevational view of a face member which differs slightly from that utilized in the embodiments of FIGS. 1 and 2.

FIG. 6 is a sectional view on an enlarged scale, the view being similar to FIG. 4 showing the male and female connection which is formed between a pair of adjacent panels formed using the face members of FIG. 5.

DESCRIPTION OF THE PREFERRED EMBODIMENT

Figure 10:
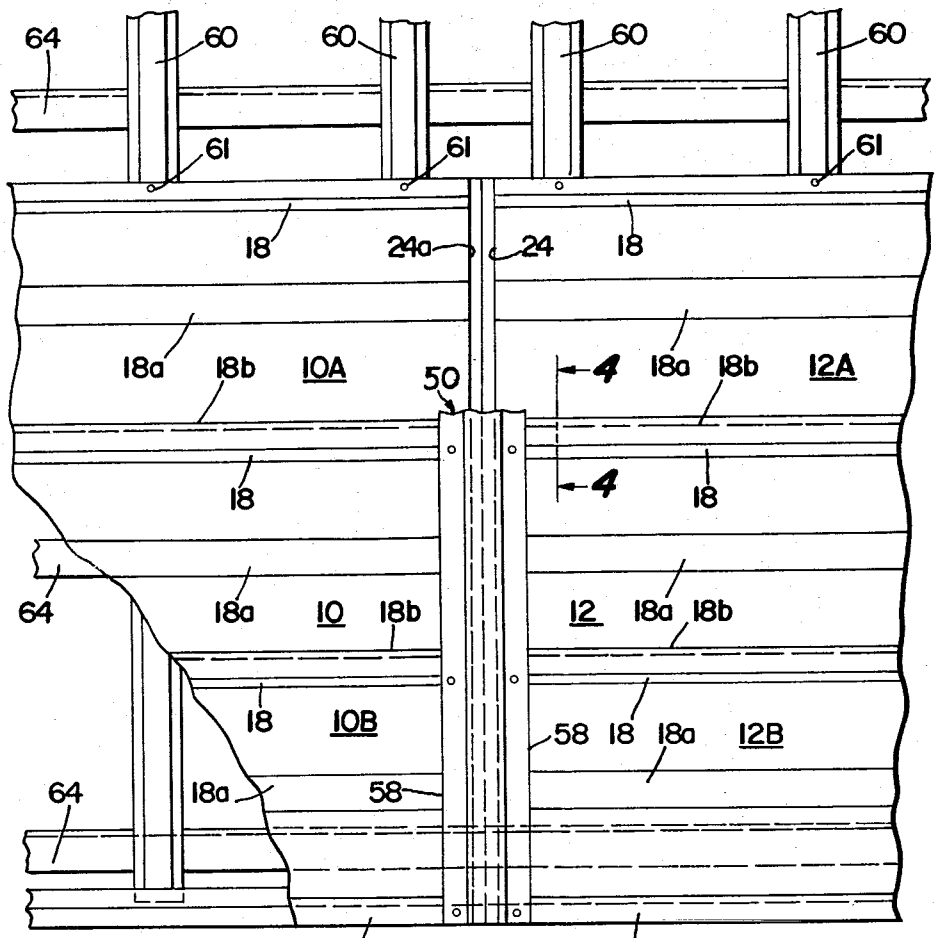
FIG. 10 is a front elevational view of adjacent panels assembled to form a supported wall structure wherein the cap strip is fastened to the adjacent panels to permit relative movement between the panels without unduly stressing the panels, portions of some of the panels being broken away to permit the viewing of otherwise hidden components.
Figure 8:
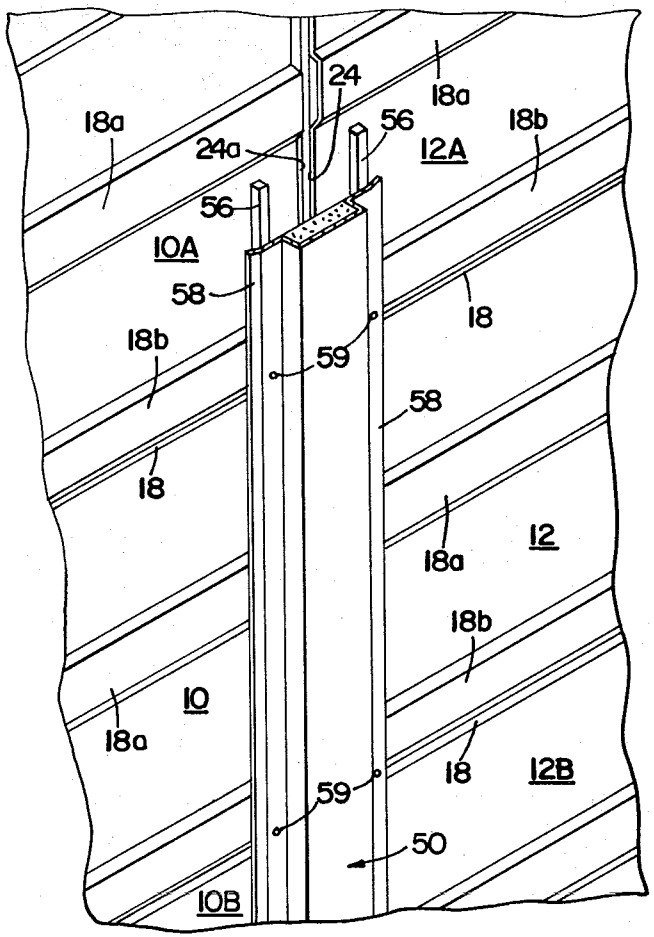
FIG. 8 is a perspective view similar to FIG. 2, showing a juncture arrangement used between the laterally disposed adjacent panels.
Figure 11:
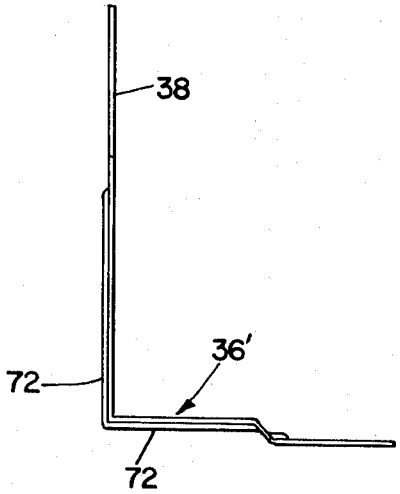
FIGS. 11 and 11A are, respectively, side and front elevational views of another embodiment of fastener clip for securing insulating mat members to the face members of panel structures.
Figure 11A:
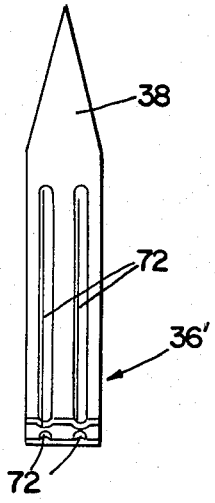
Figure 12:
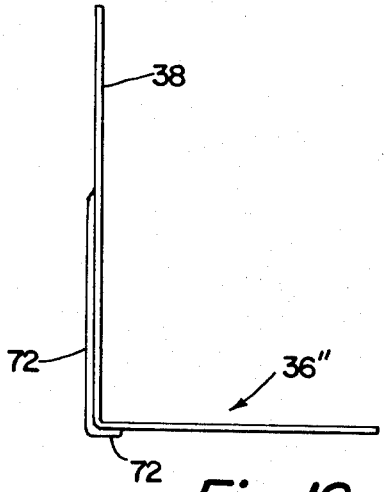
FIGS. 12 and 12A are, respectively, side and front elevational views of a further embodiment of fastener clip.
Figure 12A:
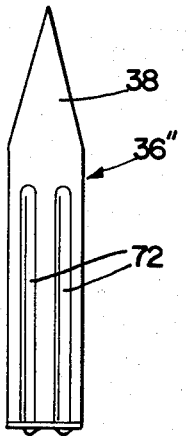

Referring to FIGS. 1, 2, 3, 8 and 10, identical prefabricated panels 10, 12 are shown assembled side-by-side. Referring particularly to FIGS 8 and 10, other identical panels 10A, 12A are shown assembled atop the panels 10, 12, while still other identical panels 10B, 12B are shown assembled below the panels 10, 12. The panels 10, 10A, 10B, 12, 12A, 12B cooperate to form a continuously extending insulated wall structure.

Each of the identical panels 10, 10A, 10B, 12, 12A, 12B comprises a face member 14 formed of sheet material. In the embodiment illustrated, the sheet member 14 is of generally rectangular configuration. The material used to form the sheet member 14 may comprise, for instance, steel or aluminum. The sheet member 14 preferably is ribbed, corrugated, or formed, as illustrated, to provide generally horizontally extending rigidifying rib sections 18, **18*a*, 18*b***.

Each face member 14 includes upper and lower opposed edges 20, 22 and spaced side edges 24, **24*a*. the upper and lower edges 20, 22 are provided with complementary male and female formations 20*a*, 22*a* extending therealong for receiving the respective complementary formations of the face members of adjacent panels, as best seen in FIGS. 3, 8 and 10. In the embodiment illustrated, the upper edge 20** is provided with the male formation 20*a* while the lower edge 22 is provided with the female formation 22*a*.

Referring to FIG. 3, the face member 14 includes a flange portion 26 which projects above the upper edge portion 20 and is offset laterally rearwardly therefrom. The flange portion 26 is connected to the male formation 20*a* of the upper edge portion 20 by means of a web section 28. The web section 28 cooperates with the flange 26 and with the male portion 20*a* to define a recess 30 extending along the top of each of the panel structures.

Figure 1:
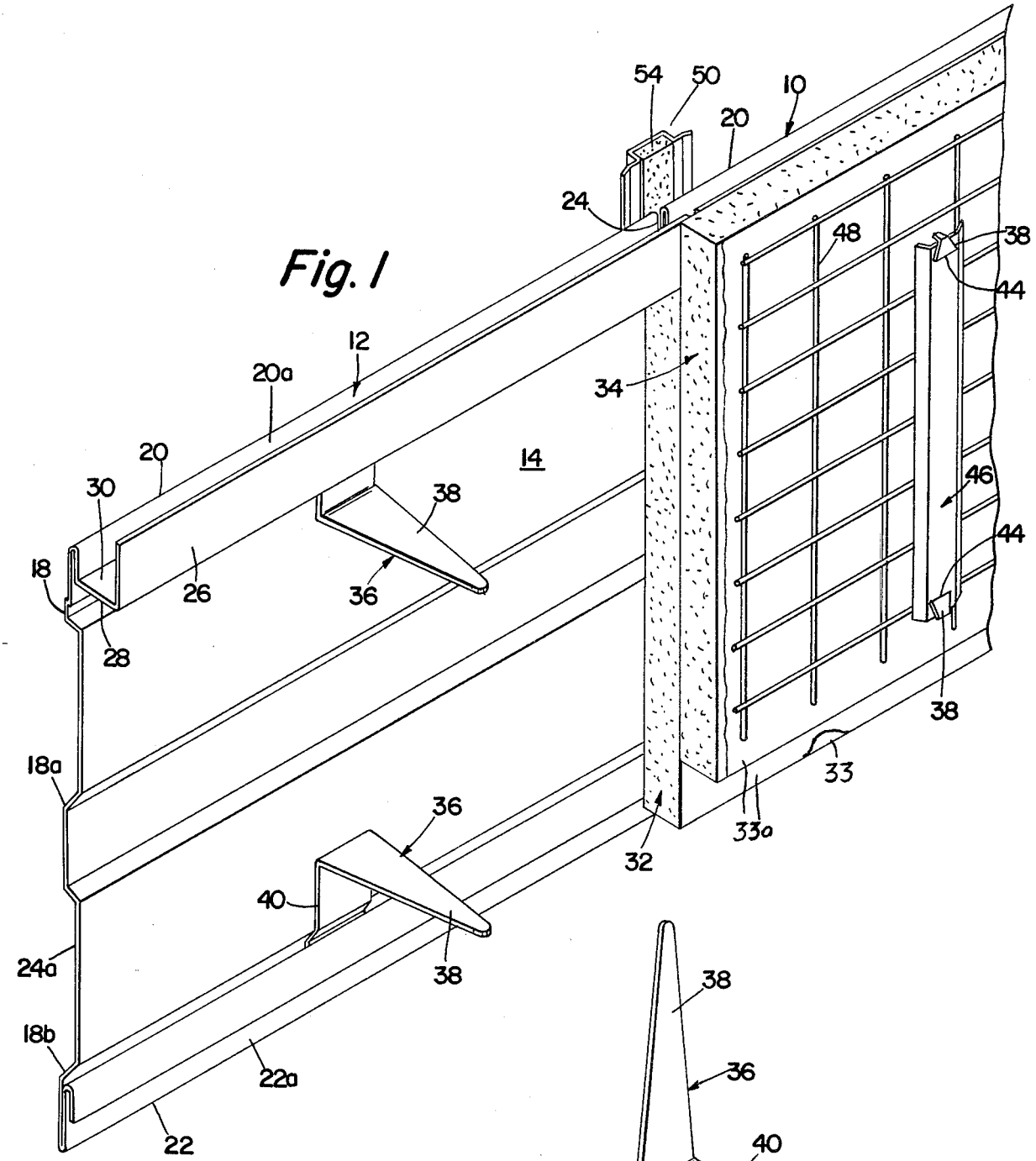
FIG. 1 is a perspective view of a pair of insulated panels assembled side-by-side in accordance with the invention, portions of the panels being broken away and/or removed to permit underlying components to be seen, the view being taken from the rear or insulated sides of the panels.
Figure 2:
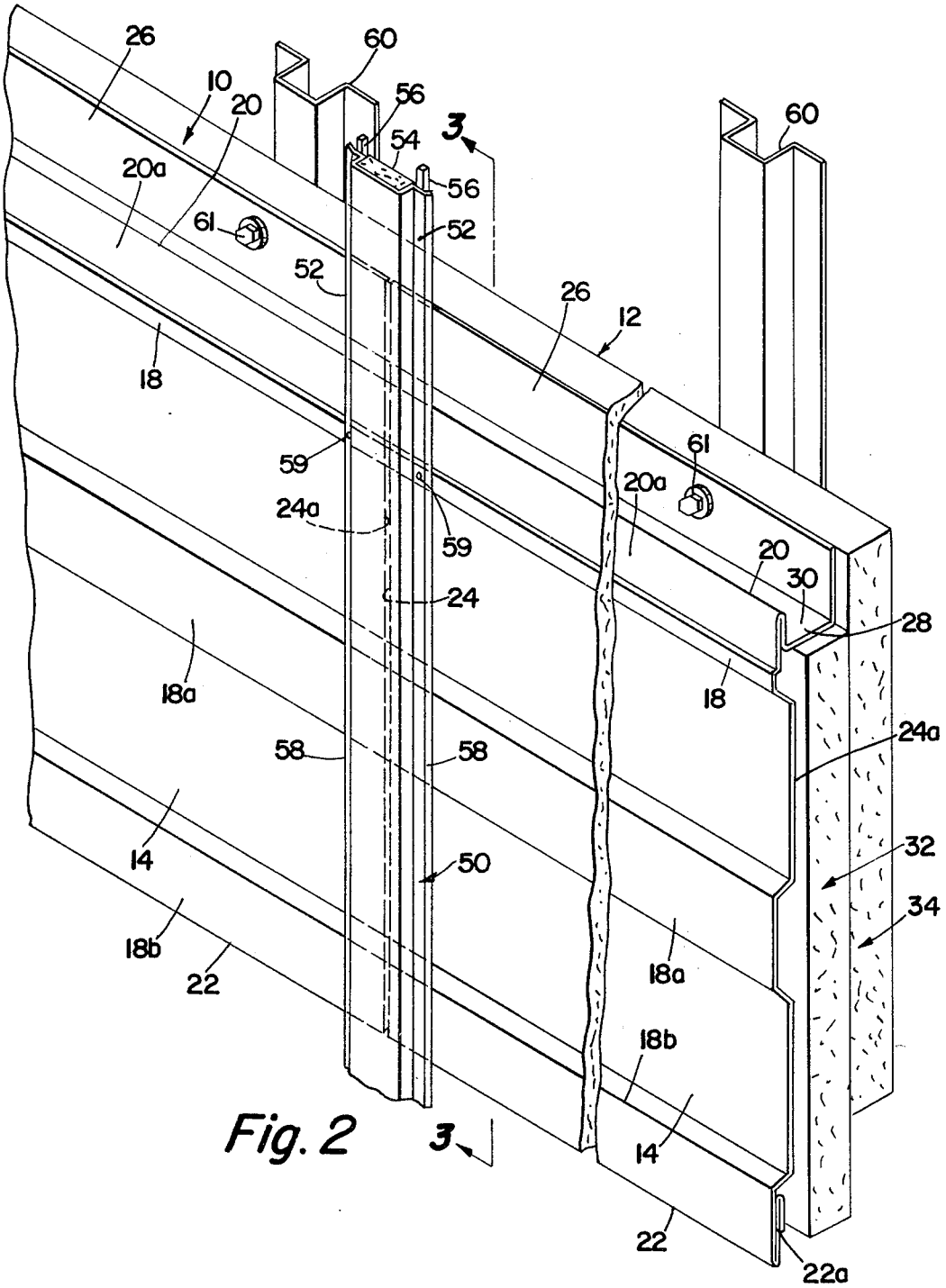
FIG. 2 is a view similar to FIG. 1 but taken from the front or opposite sides of the panels.

Referring to FIGS. 1–3, an insulating pad or mat 32 is attached to the rear surface of the face member 14. The mat 32 may be formed of any suitable insulating material, for instance fiberglass, or mineral wool or urethane. The mat 32 may have its rear face 33 covered with a reflective foil 33*a* and/or an accoustic treatment, including a lead sheet or a sheet of perforated metal. The mat 32 is of generally rectangular configuration with its upper edge engaging the under surface of the web section 28 and with its lower edge being spaced a predetermined amount above the lower edge 22 of the face member 14.

Figure 7:
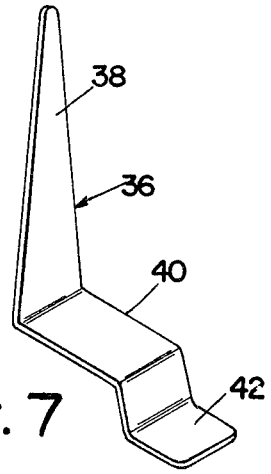
FIG. 7 is a perspective view on an enlarged scale of one type of fastener clip which may be utilized for securing insulating batt members to the face member of the panel structures illustrated in FIGS. 1 and 3.

A second batt or mat 34 of insulating material of approximately the same size as the first mat 32 is disposed in abutting relation with the first mat 32 and is offset vertically with respect thereto, as illustrated in FIGS. 1, 2 and 3. The mats 32, 34 may be secured to the front surface of the face member 14 by means of fastener clips 36 of the type shown in FIGS. 1 and 7. The clips 36 may be formed of bendable or maleable metal, such as sheet metal.

Figure 13:
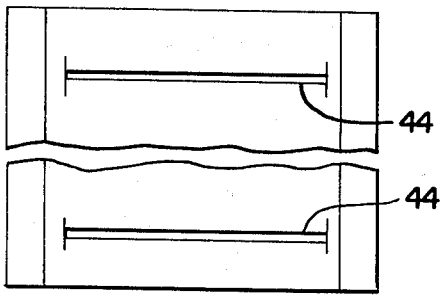
FIGS. 13 and 13A are, respectively, elevational and top plan views of a retainer strap used to retain insulation mats in place.
Figure 13A:
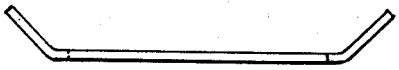

The clips 36 preferably include a pointed lance section 38, a mounting section 40, and a tab section 42. The tab sections 42 are received in or between the reversely bent sections of the upper and lower edge portions 20, 22, as best shown in FIG. 3. The lance sections 38 of the clips 36 project through the pair of abutting mats 32, 34. The distal ends of the lance sections 38 extend through slit openings 44 formed in a channel-like retainer member 46 as best seen in FIGS. 1 and 13. After the distal ends are passed through the openings 44, they are bent reversely to clamp the retaner member 46 against a wire grid 48. The grid 48 is positioned against the confronting face of the mat 34 to retain the mats 32, 34 in place relative to the face member 14.

As can be best seen in FIGS. 2, 8 and 10, the side edges of the mats 32, 34 project laterally of the side edges 24, 24*a* of the face member 14. When the panels 10, 10A, 10B, 12, 12A, 12B are assembled to form a wall structure, the side edges of the insulating mats 32, 34 are moved into tight engagement with one another but preferably in a manner which will not materially compress or buckle the insulation material.

Figure 9:
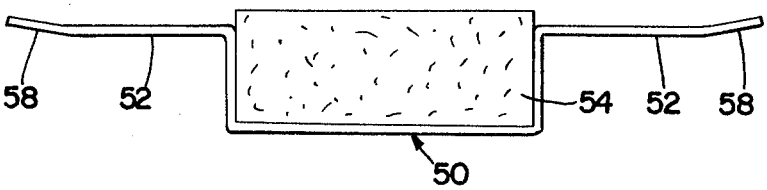
FIG. 9 is a top plan view on an enlarged scale of a cap strip utilized in the juncture arrangement of FIG. 8.

Referring to FIGS. 2, 8, 9 and 10, outer elongate cap members 50 are provided to cover the lines of juncture between laterally adjacent panels. The cap members 50 may be formed of any suitable material such as aluminum or steel or the like. In the embodiment illustrated in FIG. 9, the cap member 50 comprises a U-shaped or channel-shaped member having lateral wing portions 52 adapted to engage the confronting surfaces of the face members 14 of adjacent panels. The cap member 50 is provided with insulation 54 such as fiberglass or mineral wool disposed therein and projecting outwardly thereof, as best shown in FIG. 9. The insulation 54 is compressible and is forced against the adjacent panels to effectively seal the line of juncture between the assembled panels.

Referring to FIG. 8, closure strips 56 of flexible neoprene or any other suitable material, can also be provided between the generally resilient wing portions 52 and the confronting face members of adjacent panels. The strips 56 cooperate with inwardly bent end sections 58 of the wing portions 52, as is best seen in FIG. 9, to additionally aid in sealing the cap member 50 to the confronting surfaces of the face members 14.

The cap member 50 may be fastened by any suitable means, such as by screws 59, to the confronting surfaces of the face members 14. In preferred practice, the screws 59 are used only at one location on each respective panel, for instance at the situs of the ribs 18. Preferably no fasteners are utilized at the locations of overlap of adjacent panels. Thus, there is no mechanical fastening between panels to retard relative movement between adjacent panels. This absence of constriction aids in allowing freedom of movement of the panels relative to one another during heating and cooling, and helps to minimize panel warpage, thus aiding in maintaining a completely insulated wall structure.

As can best be seen in FIGS. 2, 4 and 10, the panels may be secured to upright support members 60. The support members 60 are of hat shape as viewed in transverse section. The panels may be connected to the uprights 60 by means of threaded fasteners 61. As is best seen in FIG. 4, the fasteners 61 extend through openings 62 formed in the flange portion 26. The fasteners 61 extend through the mat 34 and into threaded coaction with the respective upright 60. The uprights 60 may be secured, as by welds or any other suitable means, to stiffener struts 64, as best seen in FIG. 10.

Referring to FIG. 3, the top edge of the mat 34 is preferably substantially coplanar with the upper edge of the flange 26. When the panels are assembled vertically with one another, the male formation 20*a* on the lower panel is received in the female formation 22*a* on the adjacent upper panel by relative vertical sliding, to couple the panels together. However, as can be readily seen from FIG. 4, relative movement of the panels at such male-female coupling juncture, is still possible.

Referring to FIG. 3, the male formation 20*a* is formed from a reversely bent part of the sheet material of the face member 14. The sheet material of member 14 is reversely bent to form the bottom edge 22 and then is reversely bent again to form the female formation 22*a*. The female formation 22*a* is generally vertically aligned with the male formation 20*a* of the respective face member. The female formation and the association male formation are preferably of such size (or width) as will permit the complementary male and female formations to be snugly received in mating engagement. In the embodiment of FIG. 4, the web 66 of material partially defining female formation 22*a* terminates above the bottom edge 22, and above the web section 28 of the next vertically adjacent panel when these panels are assembled.

The fasteners 61 secure the panels to the support grid member 60, but still permit relative expansion and contraction of the panels. As can be seen from FIG. 4, the lower end of the mat 32 of the upper panel is received in overlapped relation to the mat 34 of the lower panel. The lower end of the upper panel mat 32 also overlaps the associated securing fastener 61 of the lower panel, and thereby provides a tortuous path for the transmission of heat from one surface of the assembled panels to the opposite surface thereof. The fact that the lower end of the innermost mat 32 overlaps the fastener 61 prevents escape of heat along the fastener, thus further enhancing the insulating characteristics of the panel.

Referring now to FIGS. 5 and 6, there is shown another embodiment of panel face member 14' which is slightly different than the face member 14 of the first described panel structure. The face member 14' has a web section 28' which is disposed somewhat lower with respect to a male formation **20*a*' as compared to the corresponding features of the first described embodiment. The face member 14' forms a somewhat deeper pocket 30' for receiving the inner mat 32 of the next vertically adjacent panel. Also, the female formation 22*a*' of the face member 14' has a web 66' which is adapted to receive the male formation 20*a*'** on the next vertically adjacent panel.

In the embodiment of FIGS. 5 and 6, the female formation **22*a*' includes a depending, diagonally arranged foot portion 66*a*' which is adapted to engage the web section 28' of the adjacent panel when coupled thereto. Such an arrangement facilitates the expeditious coupling of vertically arranged panels by guiding the movement of the male formation 20*a*' relative to the female formation 22*a*' during assembly. Moreover, the female formation 22*a*' is preferably provided with a horizontally extending dimple or rib 68 to facilitate clasping the male formation 20*a*' when received therein. Moreover, the upper end of the female formation 22*a*' may be beveled outwardly as at 69 and then inwardly to further aid in causing the web 66' to clasp the male formation 20*a* '** when received therein.

When the panels are assembled to form a wall structure, the wall structure provides optimum insulating characteristics while, at the same time, providing for relative expansion and contraction of the panels. Such a wall structure may be utilized in high temperature environments, for instance, those utilized to provide insulation in an area having a temperature in the range of, for instance, from 0 degrees F. to 1000 degrees F.

Referring now to FIGS. 11, 11A, 12 and 12A, there are illustrated other embodiments of bendable mat fastener clips 36', 36''. The clip 36' is adapted for use as the lowermost clip in a panel assembly. The clip 36'' is adapted for use as the upper clip in a panel assembly. The upper clip 36'' will be dispensed closer to the web section 28 of the face member 14 and generally above a diagonal portion 70 of the upper face member rib 18 as best seen in FIG. 3. Both of the clips 36', 36'' include integrally formed stiffener rib formations 72.

Wall structures embodying the preferred practice of the present invention provide for weather integrity. All of the anchoring fasteners, such as the fasteners 61, are concealed and do not provide any opportunity for water penetration from the noninsulated surface to the insulated surface. The overlap of metal at the male-female coupling joints precludes any direct water entrance, and the joints between laterally adjacent panels are sealed by the insulated caps 50 and the associated sealing strips 56. One man can handle a panel and install it without the necessity of a second workman to hold the panel in position until it is anchored by the fasteners 61. Since there is no direct heat transmission by the fasteners 61 through the panel wall structure, the surface of the noninsulated side of the panel may be painted using conventional paints without the disadvantage of browned or hot spots occurring on the external panel surface.

The face members 14 and 14' are preferably formed from single pieces of metal. While the panels have been illustrated and described as being assembled so that the male-female formations **20*a*, 22*a* extend horizontally, it will be understood that the panels could be arranged so that the male-female couplings extend vertically, in which event the ribs 18, 18*a*, 18*b*** on the face members would be oriented vertically rather than horizontally. Accordingly, it will be understood that the terms "vertically" and "horizontally" as used herein, are simply for descriptive purposes, and are not intended to indicate that the orientation of the panels needs to be as described.

From the foregoing description and accompanying drawings, it will be seen that the invention provides a novel prefabricated insulated panel adapted to be assembled with like panels, to form an insulated wall structure. Suitable juncture systems are provided for expeditiously coupling the panels together and for preventing heat transmission through the wall structure from its hot side to its cold side.

The terms and expressions which have been used are used as terms of description and not of limitation. It is not intended that the use of such terms and expressions should exclude any equivalents of any of the features shown or described. It is recognized that various modifications are possible within the scope of the invention claimed. It is intended that the appended claims shall cover by suitable expression whatever features of patentable novelty reside in the present invention.

What is claimed is:

1. A prefabricated insulated panel adapted to be assembled with like panels to form an insulated wall structure, the panel comprising a face member of sheet material having first and second opposed edges and side edges, the opposed edges being provided with complimentary male and female formation means extending, respectively, substantially coextensively therealong for receiving the respective complementary formation means of vertically adjacent panels when assembled therewith to couple adjacent panels together in one direction of orientation, the male formation means extending along the first edge and including a generally upstanding flange portion offset laterally from the first edge and being connected thereto by a web section, a first insulating mat extending along one surface of the face member and insulating the latter, the first mat being positioned against that surface of the face member from which the flange and web section extend, the first mat having first and second opposed edges extending, respectively, along and near the first and second edges of the face member, the second edge of the mat terminating inwardly from the second edge of the face member and being adapted to be received in a recess defined by the first edge of the face member and the associated web section and flange of the next adjacent panel when the panels are assembled, the flange being adapted for attaching the panel to an associated elongate support and for aiding in preventing heat flow through the panel at the situs of attachment of the panel to the support, a second insulating mat extending along the first mat, the second mat having first and second opposed edges extending, respectively, along and near but being offset with respect to the first and second opposed edges of the first mat, the first and second insulating mats being held in place by a fastener means detachably coupled to the face member and extending through at least one of the insulating mats for holding the insulating mats in place, the fastener means being in the form of bendable prongs.

2. A panel in accordance with claim 1 wherein the first edge of the first mat is generally engaged with the inner surface of the web section.

3. A panel in accordance with claim 1 wherein the second and first mats are within the confines of the first and second edges of the face member.

4. A panel in accordance with claim 1 wherein the second mat is substantially the same area as the first mat.

5. A panel in accordance with claim 1 including retainer means engaging the exterior surface of the second mat and cooperating with the fastener means in holding the mats in place against the one surface.

6. A panel in accordance with claim 1 wherein the first mat extends laterally outwardly beyond a corresponding lateral extremity of the face member, the lateral extension of the first mat being adapted for abutting relation with a corresponding first mat of a next laterally adjacent panel, when assembled therewith.

7. A panel in accordance with claim 1 wherein the face member and the first mat are of generally parallelogram configuration.

8. A panel in accordance with claim 1 including generally laterally extending ribs formed from the sheet material and rigidifying the face member.

9. A panel in accordance with claim 1 wherein the first mat at its upper edge engages the inner surface of the web section, with the thickness of the mat extending substantially to the place of the flange portion, the top edge of the second mat projecting outwardly beyond the second edge of the first mat, the first edge of the second mat being substantially coplanar with the extremity of the flange portion, and with the bottom edge of the second mat being disposed a predetermined amount above the second edge of the first mat.

10. A panel in accordance with claim 1 wherein the female formation means is formed from the sheet material of the face member by bending the latter upon itself adjacent to the second edge of the face member and then bending the material again upon itself to form a generally flexible reach terminating inwardly of the second edge of the face member, the female formation means being adapted to receive therein the male formation means of the next adjacent panel when assembled therewith, the width of the male formation means being at least as great as the unexpanded width of the female formation means to receive the male formation means therein in generally snug relation upon assembly.

11. A panel in accordance with claim 10 wherein the reach includes an obliquely extending foot portion, for guiding the male formation means into the female formation means.

12. A panel in accordance with claim 11 wherein the female formation means is corrugated generally longitudinally along the reach to rigidify the reach.

13. A prefabricated insulated panel adapted to be assembled with like panels to form an insulated wall structure, the panel comprising a face member of sheet material having first and second opposed edges and side edges, the opposed edges being provided with complementary interfitting male and female formation means extending, respectively, substantially coextensively therealong for receiving the respective complemetary formation means of vertically adjacent panels when assembled for coupling adjacent panels together in one direction of orientation when the panels are moved toward each other in such direction to bring said formation means into interfitting engagement, the male formation means including a generally upstanding flange portion offset laterally from the first edge and being connected thereto by a web section, a first insulating mat extending along one surface of the face member and insulating the latter, the first mat having first and second opposed edges extending respectively along and near the first and second edges of the face member, the second edge of the mat terminating inwardly from the second edge of the face member and being adapted to be received in a recess defined by the first edge of the face member and the associated flange of the next adjacent panel when in assembled relation therewith, the flange being adapted for attaching the panel to an associated elongate support and for aiding in preventing heat flow through the panel at the situs of attachment of the panel to the support, a second insulating mat extending along the first mat, the second mat having first and second opposed edges extending respectively along and near but being offset with respect to the first and second opposed edges of the first mat, and fastener means in the form of bendable prongs detachably coupled to the face member and extending through at least one of the insulating mats for holding the insulating mats in place.

14. A panel in accordance with claim 13 including retainer means engaging the exterior surface of the second mat and cooperating with the fastener means in holding the mats in place against the one surface.

15. A wall structure comprising a plurality of prefabricated insulated panels assembled with one another to form an insulated wall, each of the panels comprising a face member of sheet material having opposed first and second edges and side edges, the first and second edges being provided with complementary male and female formation means, respectively, for coupling adjacent panels together, the face member of each panel including a generally upstanding flange portion offset laterally from the first edge and being connected thereto by a web, a first insulating mat extending along one surface of the face member and insulating the face member, the first mat having first and second opposed edges, the first mat edge extending along the inside of the web, the second mat edge terminating inwardly from the second edge of the face member and being received in a recess extending along the first edge of the face member and an associated flange of the next adjacent panel, a second insulating mat disposed in juxtaposed relation with the first mat and projecting outwardly beyond the first mat, mounting means in the form of bendable prongs extending through at least one of the mats for securing the first and second insulating mats to the face member, and fastener means coacting with each flange securing each respective panel to a support, the fastener means including a threaded fastener extending through the flange and through the second mat to attach the respective panel to the support, an edge of the first mat being received in the recess and covering the fastener of the next adjacent panel thus preventing heat flow from one side of the assembled panels to the other side thereof at the situs of the fastener connections of the panels to the support.

16. A wall structure in accordance with claim 15 wherein the mats of each of the panels extend laterally outwardly beyond the corresponding extremities of the respective face member and into abutting relation with the lateral extension of the mats of the next laterally adjacent panel to form a juncture seam, a cap member abutting the confronting face members of the laterally adjacent panels along the seam, fastener means securing the cap member to the confronting face members, and sealing means coacting between the cap member and said confronting face members to seal the seam.

17. A wall structure in accordance with claim 16 wherein the fastener means extends only through non-overlapping sections of the confronting face members.

18. A prefabricated insulated panel adapted to be assembled with like panels to form an insulated wall structure, the panel comprising a face member of sheet material having first and second opposed edges and side edges, the opposed edges being provided with complimentary male and female formation means extending, respectively, substantially coextensively therealong for receiving the respective complementary formation means of vertically adjacent panels when assembled therewith to couple adjacent panels together in one direction of orientation, a generally upstanding flange portion offset laterally from a selected one of the first and second edges and being connected thereto by a web section, the first insulating mat extending along one surface of the face member and insulating the latter, the first mat being positioned against that surface of the face member from which the flange and web section extend, the first mat having first and second opposed edges extending, respectively, along and near the first and second edges of the face member, a chosen one of the first and second edges of the mat terminating inwardly from the selected edge of the face member and being adapted to be received in a recess defined by a flange and web section, the other edge of the mat engaging the web section of the next adjacent panel when the panels are assembled, the flange being adapted for attaching the panel to an associated elongate support and for aiding in preventing heat flow through the panel at the situs of attachment of the panel to the support, a second insulating mat extending along the first mat, the second mat having first and second opposed edges extending, respectively, along and near but being offset with respect to the first and second opposed edges of the first mat, and fastener means detachably coupled to the face member and extending through at least one of the insulating mats for holding the insulating mats in place, the fastener means being in the form of bendable prongs.

19. A panel in accordance with claim 18 wherein the male formation means extends along the first edge, the flange portion is offset laterally from the first edge, and the second edge of the first mat terminating inwardly from the second edge of the face member and being received in a recess defined by the first edge of the face member and the associated web section and flange of the next adjacent panel when the panels are assembled.

20. A wall structure comprising a plurality of prefabricated insulated panels assembled with one another to form an insulated wall, each of the panels comprising a face member of sheet material having opposed first and second edges and side edges, the first and second edges being provided with complementary male and female formation means, respectively, for coupling adjacent panels together, the face member of each panel including a generally upstanding flange portion offset laterally from the first edge and being connected thereto by a web, a first insulating mat extending along one surface of the face member and insulating the face member, the first mat having first and second opposed edges, the first mat edge extending along the inside of the web, the second mat edge terminating inwardly from the second edge of the face member and being received in a recess extending along the first edge of the face member and an associated flange of the next adjacent panel, a second insulating mat disposed in juxtaposed relation with the first mat and projecting outwardly beyond the first mat, mounting means securing the first and second insulating mats to the face member, fastener means coacting with each flange securing each respective panel to a support, the fastener means including a threaded fastener extending through the flange and through the second mat to attach the respective panel to the support, an edge of the first mat being received in the recess and covering the fastener of the next adjacent panel thus preventing heat flow from one side of the assembled panels to the other side thereof at the situs of the fastener connections of the panels to the support, and wherein the mats of each of the panels extend laterally outwardly beyond the corresponding extremeties of the respective face member and into abutting relation with the lateral extension of the mats of the next laterally adjacent panel to form a juncture seam, a cap member abutting the confronting face members of the laterally adjacent panels along the seam, fastener means securing the cap member to the confronting face members, and sealing means coacting between the cap member and said confronting face members to seal the seam.

21. A wall structure in accordance with claim 20 wherein the fastener means extends only through non-overlapping sections of the confronting face members.

* * * * *